US006231233B1

(12) United States Patent
Orce

(10) Patent No.: US 6,231,233 B1
(45) Date of Patent: May 15, 2001

(54) BAG FOR THE SAFE-KEEPING OF PERSONAL BELONGINGS HAVING SPACES FOR CHANGEABLE GRAPHIC ADVERTISING

(76) Inventor: Dante Alberto Orce, Manuel Estrada nr., 1379 Banfield Oeste-Pcia. de Buenos Aires (AR)

( * ) Notice: Subject to any disclaimer, the term of this patent is extended or adjusted under 35 U.S.C. 154(b) by 0 days.

(21) Appl. No.: 09/407,860

(22) Filed: Sep. 29, 1999

(30) Foreign Application Priority Data

Oct. 27, 1998 (AR) ..... M 98 01 05361

(51) Int. Cl.[7] ..... B65D 30/22

(52) U.S. Cl. ..... 383/38; 383/97; 383/106; 150/101; 150/104; 150/117

(58) Field of Search ..... 383/38, 40, 97, 383/106, 5; 150/103, 104, 105, 117, 101

(56) References Cited

U.S. PATENT DOCUMENTS 2,522,549 * 9/1950 Waggoner ..... 150/104
2,920,671 * 1/1960 Siris et al. ..... 150/103 X
3,556,187 * 1/1971 Speakes ..... 150/104 X
4,156,446 * 5/1979 Nathan ..... 383/39 X
4,494,592 * 1/1985 Bonner ..... 383/97 X
5,149,202 * 9/1992 Dickert ..... 383/39 X

FOREIGN PATENT DOCUMENTS 2 406 969 * 6/1979 (FR) ..... 150/104

* cited by examiner

*Primary Examiner*—Jes F. Pascua
(74) *Attorney, Agent, or Firm*—Venable; John P. Shannon

(57) ABSTRACT

A bag constituted by a laminar outer part which is completely transparent and portions having overlapped inner laminar opaque portions, including inner pockets wherein planar plates containing graphic advertising are housed. Said inner pockets have zip fasteners as well as the bag mouth. The sliding tab of the zip fastener includes an inviolable lock. At least a portion of the bag side wall is completely transparent, thus allowing visualization of the objects contained therein from outside with the bag closed. The bag of the invention may also have a smaller outer pocket.

7 Claims, 2 Drawing Sheets

BAG FOR THE SAFE-KEEPING OF PERSONAL BELONGINGS HAVING SPACES FOR CHANGEABLE GRAPHIC ADVERTISING

The instant invention relates to a bag for the safe-keeping of personal belongings which has spaces for carrying changeable graphic advertising, to be used, basically, in supermarkets, self-service shops in general and the like (hereinbelow called "shops"). The bag of the invention has special constructive features affording a distinctive and convenient character thereto, since two basic needs in shops and clients are covered: service and safety.

The bag is intended to keep safely the clients' belongings while they walk along the commercial premises selecting the products to be acquired.

Thus, responsibility of the shop's owner on such personal belongings is avoided.

With the bag of the invention, a safety device is attained for the benefit of the commercial entity as well as of the clients. The bag has a practical and versatile design, avoiding the cumbersome checking, by the shop personnel, of clients' belongings in order to detect eventual stealings; it also prevents queues for recovering the clients' belongins in case same are kept in custody by the shop personnel, and makes circulation of the clients within the shop premises easier and more comfortable.

The bag of the invention prevents dishonest clients from stealing articles hidden among their personal belongings, thus minimizing "internal losses" due to small scale robbery.

Further, an additional advantage of the bag of the invention is that it has spaces for inserting graphic adverting, which may be changed as desired, or carrying messages of any kind for the clients.

The bag of the invention may be also used in any kind of commercial firm such as societies, associations, etc.

By way of example only, the bag of the invention may be used in:

1. All kind of commercial, industrial and service firms for the safe-keeping of personal belongings of employees.
2. All kind of associations, clubs, meeting rooms or showrooms wherein attendance of great numbers of individuals is foreseen, for the safe-keeping of personal belongings.
3. In any kind of firm or activity as internal or external courier.

Essentially, the bag of the invention constitutes an inviolable resource for protecting personal belongings. These articles are kept inside the bag and may be seen from outside. The bag is closed by an inviolable locking means and the individual involved carries it during his/her stay in the shop. Upon leaving the premises, an employee, who may be the cashier, opens the bag using a mechanical or electric-mechanical deactivator, the client takes his/her belongings off and the bag is ready for being used again.

PRIOR ART

This kind of safe-keeping is required in the case of persons carrying hand-bags, portfolios or products acquired in other shops. The above is due to the fact that in most of commercial premises clients cannot not enter carrying their own belongings as a safety measure against robbery.

At present, the client is invited to leave his/her belongings in a safety area, controlled by personnel of the firm, and is given a ticket for recovering such belongings upon leaving the shop. Also, such belongings may be kept into boxes closed by locks, the client carrying the key.

Both modes of protection have disadvantages in what concerns to practical considerations and cost.

In fact, the client may lose the ticket or the key, this generating a problem which could be increased by the fact that such ticket or key may be found by another person who may then steal such belongings.

It has also been demonstrated that safety boxes are easily accessible to thieves who, pretending being a client of the shop, open such boxes and steal personal belongings of the clients. Therefore, many commercial premises have instituted a strict vigilance by skilled personnel, which results in a substantial additional cost.

Also, most of the clients entering a shop are reluctant to leaving their personal belongings due to their private character.

Exceptionally, clients may enter a shop carrying their handbags or portfolios, but in many cases their belongings have been stolen by thieves.

Novelty and Main Object of the Invention

The above mentioned disadvantages are overcome by the bag of the invention.

In fact, the safe-keeping bag of the invention has a zip fastener the sliding tab of which includes an inviolable locking means. Further, the bag walls have transparent portions allowing visualization of the contents of the bag from outside at any time.

Further, the bag has internal pockets, with zip fasteners, inaccessible to clients, wherein removable advertising boards may be placed.

These "advertising spaces" are exposed permanently inside the premises, thus creating some kind of "moving advertising", carried by the client's hand or shoulder, or on the sliding shopping carts.

These advertising means may serve to increase profits or to give communications such as notices, greetings in special days, etc. to the clients.

Outer pockets are also contemplated, wherein other personal belongings may be kept, such as telephones, calculators, etc. which could be used by the client during his/her stay at the premises.

In order to hang the bag from the cart, a pair of removable loops is contemplated.

BRIEF DESCRIPTION OF THE DRAWINGS

A preferred embodiment of the invention will be now described, merely as a non-limiting example and without a determined scale, in connection with the accompanying drawings, in which.

In all figures, the same reference numerals designate the same or equivalent parts.

DETAILED DESCRIPTION OF A PREFERRED EMBODIMENT

Figure 1:
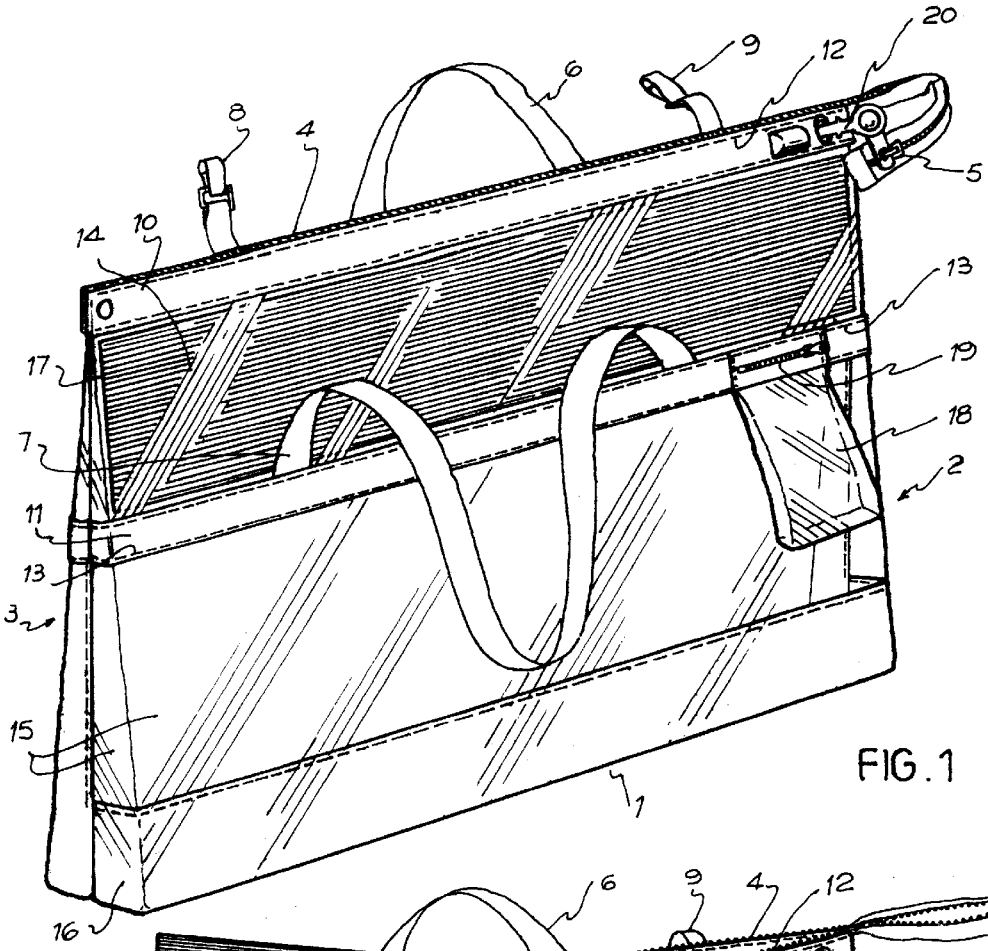
FIG. 1 is a perspective view of the bag of the invention in its closed position.

As may be seen in the figures, the bag of the invention is comprised by textile panels joined by perimetric seams forming an enclosure having a bottom 1 and side walls 2 and 3, and a large upper mouth which may be closed by a zip fastener 4 having a sliding tab 5 including the inviolable closure lock (not shown).

The bag also includes side handles 6 and 7 comprised by planar belts joined to the side walls by means of seams and complemented by a pair of loops 8 and 9 for removably hanging the bag from the sliding shopping cart. Therefore, the bag is visible and safe-kept by the client during his/her stay at the commercial premises.

Figure 2:
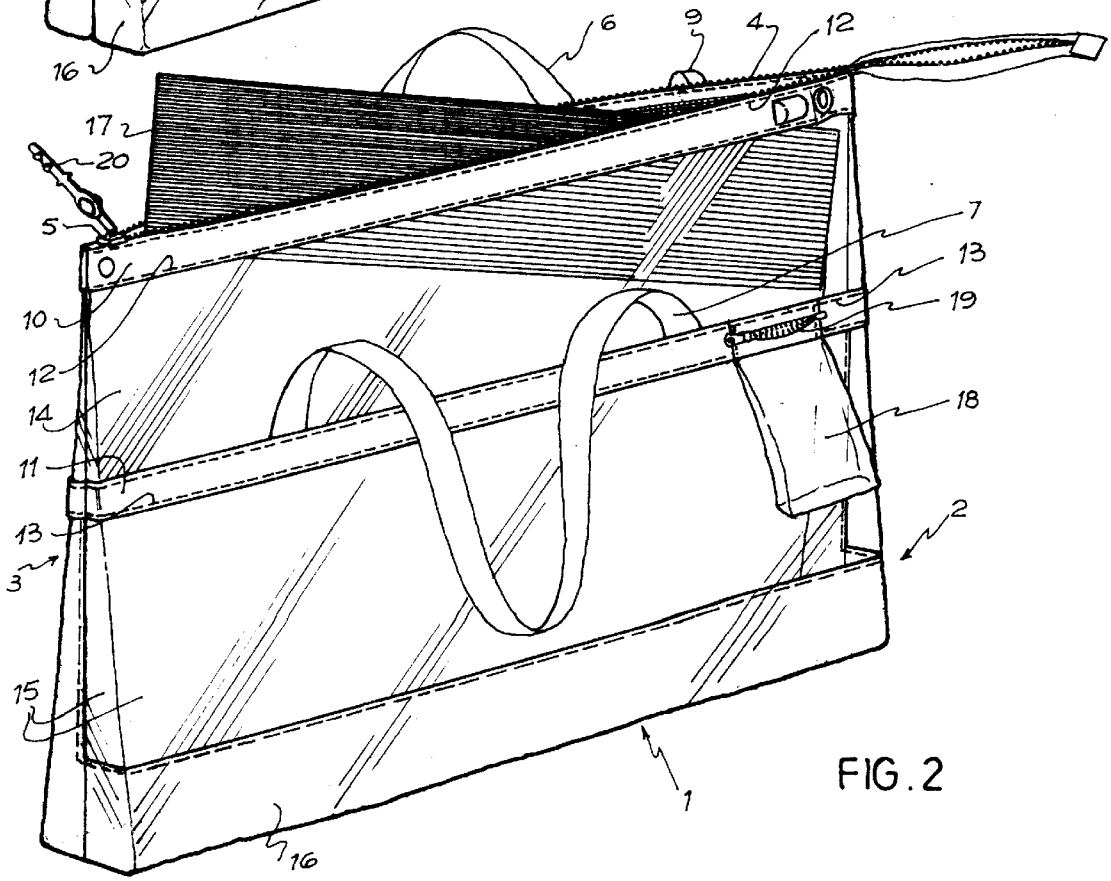
FIG. 2 is another perspective view, similar to that of FIG. 1, showing the bag in its open position.
Figure 3:
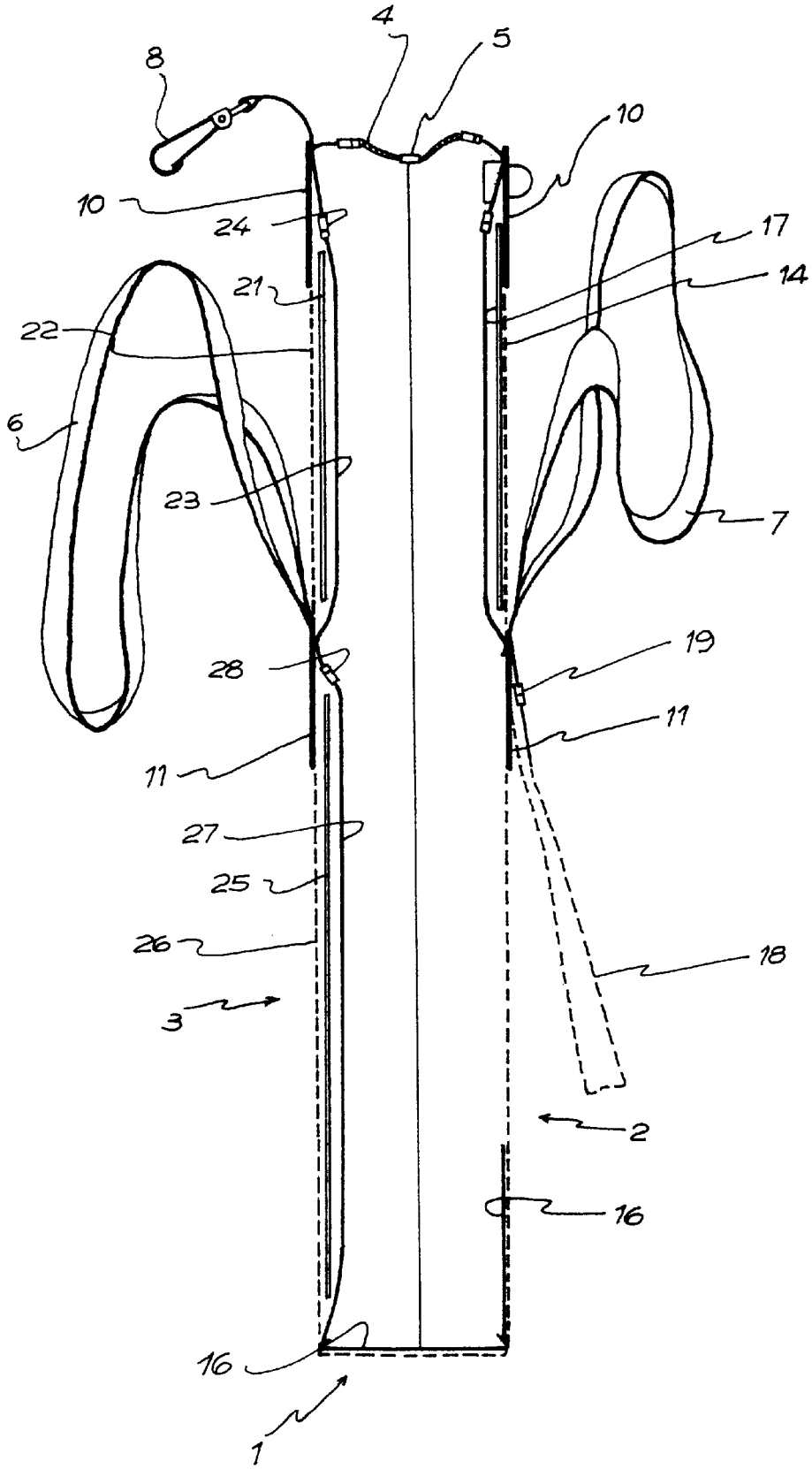
FIG. 3 is a vertical schematic section of the bag of former figures, illustrating the operative conditions thereof.

With reference to FIGS. 1 and 2, the bag of the invention has two outer annular planar strips 10 and 11 which are used for joining by seam lines 12 and 13 the different portions forming the bag side walls, as well as the zip fastener means 4 of the upper mouth and of other internal pockets which may be seen in FIG. 3. At the visible faces in these figures, portions 14 and 15 are transparent, while the lower portion 16 continuing through the bottom base, is opaque. It is clear from this figure, that any object inside the bag may be perfectly seen from the outside, without opening the bag.

The mentioned transparent upper portion 14 is a pocket extending on the whole front width of the bag and is provided for removably housing plate 17 bearing advertising messages.

Further, on said planar strip 11 an outer pocket 18 is fixed, having its own closure 19, which is useful for carrying elements such as a personal telephone or calculator to be used during shopping.

The free end of the sliding tab 5 has a closure means 20 of the kind which may be locked in a inviolable manner and which may only be easily unlocked through an unlocking means such a mechanical or electric-mechanical element used by personnel of the shop when the client pays the account and leaves the premises. At this time, personal belongings of the client are removed from the bag.

FIG. 3 clearly shows the way in which the bag is constituted. It may be seen that on face 3 of the bag, which was not shown in former figures, there is also an upper plate bearing advertising 21 housed into an inner pocket defined by the front transparent portion 22, the back opaque portion 23 and the zip fastener 24. Further, the lower portion of face 3 has another pocket housing an advertising plate 25, larger than former ones, enclosed by a front transparent portion 26, an opaque back 27 and a zip fastener 28.

All internal pockets as well as the belongings housed inside the bag, have no access to clients since this is prevented by the upper zip fastener 4.

What is claimed is:

1. Bag for the safe-keeping of personal belongings having spaces for rechargeable graphic advertising, to be used for keeping personal belongings of customers before entering a premises, the bag comprising a flexible body formed by sheets of material joined by seams for defining two main side walls, a bottom and an upper mouth, the sheets including an outer sheet forming both said walls and the bottom, which outer sheet is transparent; and two annular planar strips for supporting and fixing, through a seam, the outer sheet bag and laminar internal parts which, being opaque, extend along upper and lower portions of the bag, the laminar internal parts defining backing means for corresponding inner pockets, the bottoms of said pockets being defined by one of the seams by which the outer sheet is fixed to the laminar internal parts.

2. Bag for safe-keeping of personal belongings, as claimed in claim 1, characterized in that one of said annular planar strips is positioned at the container mouth and the other of said annular planar strips is located at the middle of said side walls.

3. Bag for safe-keeping of personal belongings, as claimed in claim 1, characterized in that the inner pockets extend along a length equivalent to the bag width and have a height smaller than the total height of said bag.

4. Bag for safe-keeping of personal belongings, as claimed in claim 1, characterized in that said inner pockets include zip fasteners.

5. Bag for safe-keeping of personal belongings, as claimed in claim 1, characterized in that an outer pocket with zip fastener is located on one of the side walls.

6. Bag for safe-keeping of personal belongings, as claimed in claim 1, characterized in that upper mouth has an inviolable closure means.

7. Bag for safe-keeping of personal belongings, as claimed in claim 1, characterized in that at least one of said inner pockets houses a plate bearing an advertisement.

* * * * *